US009415433B2

(12) United States Patent
Moore

(10) Patent No.: US 9,415,433 B2
(45) Date of Patent: Aug. 16, 2016

(54) SCRAP SHAPE RETENTION

(75) Inventor: William R. Moore, Barrie (CA)

(73) Assignee: HONDA MOTOR CO., LTD., Tokyo (JP)

( * ) Notice: Subject to any disclaimer, the term of this patent is extended or adjusted under 35 U.S.C. 154(b) by 917 days.

(21) Appl. No.: 13/504,895

(22) PCT Filed: Jun. 29, 2010

(86) PCT No.: PCT/CA2010/001036

§ 371 (c)(1),
(2), (4) Date: Apr. 27, 2012

(87) PCT Pub. No.: WO2011/050443

PCT Pub. Date: May 5, 2011

(65) Prior Publication Data

US 2012/0210764 A1 Aug. 23, 2012

(30) Foreign Application Priority Data

Oct. 30, 2009 (CA) ..... 2685334

(51) Int. Cl.
*B21D 22/22* (2006.01)
*B21D 24/16* (2006.01)
*B21D 53/88* (2006.01)

(52) U.S. Cl.
CPC ..... *B21D 22/22* (2013.01); *B21D 24/16* (2013.01); *B21D 53/88* (2013.01)

(58) Field of Classification Search
CPC ..... B21D 22/02; B21D 22/22; B21D 24/16; B21D 53/88
USPC ..... 72/334, 337, 338, 347, 348, 350
See application file for complete search history.

(56) References Cited

U.S. PATENT DOCUMENTS 2,002,097 A * 5/1935 Peterson ..... 72/297
2,064,160 A * 12/1936 Hochreiter et al. ..... 72/312

(Continued)

FOREIGN PATENT DOCUMENTS

JP 61-205620 A 9/1986
JP 63-154216 A 6/1988

(Continued)

OTHER PUBLICATIONS

International Search Report and Written Opinion for PCT/CA2010/001036 dated Oct. 26, 2010.
International Preliminary Report on Patentability for PCT/CA2010/001036 dated Feb. 13, 2012.

*Primary Examiner* — David Bryant
*Assistant Examiner* — Lawrence Averick
(74) *Attorney, Agent, or Firm* — Standley Law Group LLP

(57) ABSTRACT

Disclosed herein is a sheet metal stamping device and method for substantially inhibiting recoil from a neutral stamped position of a scrap part region. A sheet metal stamping device for stamping a sheet metal part comprising a first die body and a second is provided wherein the first die body and the second die body are in operable communication for forming the sheet metal part from a sheet metal blank. The sheet metal part includes at least one scrap region formed therein which is prone to recoil from a neutral stamped position. The first die body and the second die body have complementary elongate bead-forming regions located for forming an elongate bead region in the scrap region. And, the elongate bead-forming regions are configured such that the elongate bead substantially inhibits recoil or springback of the scrap region from the neutral stamped position when the scrap region is severed from the part. A method of stamping a sheet metal part having at least one scrap region prone to recoil formed therein utilizing the device and severing the scrap region is also disclosed.

18 Claims, 9 Drawing Sheets

(56) References Cited

U.S. PATENT DOCUMENTS

| | | | | |
|---|---|---|---|---|
| 4,581,913 | A | 4/1986 | Reed | |
| 5,361,619 | A * | 11/1994 | Kojima et al. | 72/348 |
| 6,474,126 | B1 * | 11/2002 | Webster | B21D 22/21 72/347 |
| 7,464,011 | B2 | 12/2008 | Ren | |
| 2005/0044913 | A1 * | 3/2005 | Ni | B21D 26/033 72/61 |
| 2006/0137422 | A1 * | 6/2006 | Kodaka et al. | 72/350 |
| 2008/0184764 | A1 * | 8/2008 | Nakamura et al. | 72/350 |
| 2009/0188294 | A1 * | 7/2009 | Birkenstock et al. | 72/349 |

FOREIGN PATENT DOCUMENTS

| | | | |
|---|---|---|---|
| JP | 2046931 | | 2/1990 |
| JP | 03035825 | A | 2/1991 |
| JP | 3086328 | A | 4/1991 |
| JP | 06226368 | A | 8/1994 |
| JP | 11277157 | A | 10/1999 |
| JP | 2001-58217 | A | 3/2001 |
| JP | 2003053445 | | 2/2003 |
| JP | 2008-221253 | A | 9/2008 |

* cited by examiner

Fig.7
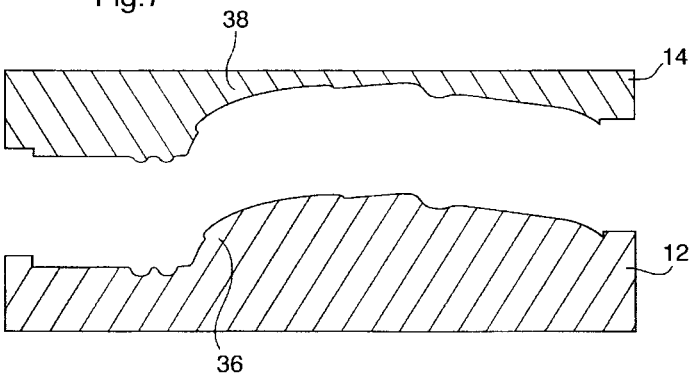
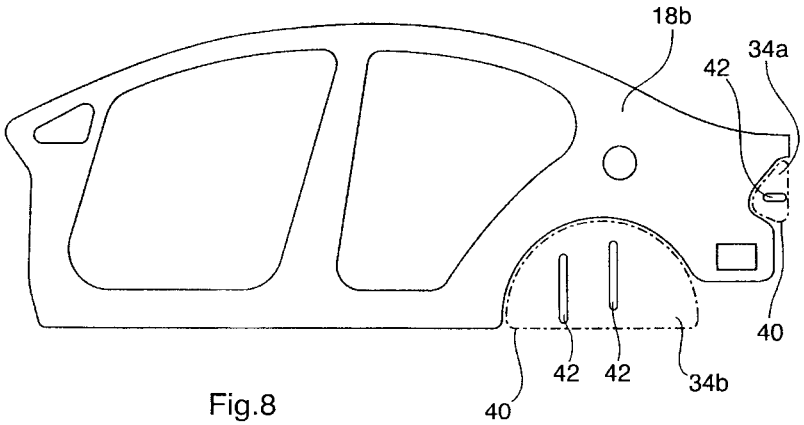
Fig.8

SCRAP SHAPE RETENTION

FIELD OF THE INVENTION

The present invention relates to the shape retention of scrap regions of sheet metal parts when the scrap region is severed from the final part.

BACKGROUND OF THE INVENTION

The stamping industry has been confounded with a problem, in the scrap regions or addendum, of a stamped part becoming jammed in the scrap-trimming and removal mechanisms. When a stamped part is produced, it often has excess regions or scrap regions, known in the industry as the addendum, owing to the shape of the sheet metal blank from which the stamped part is produced. The addendum is formed because of the necessary amount of sheet metal blank material that is required at various locations of the final part due to the depth of the part drawn within the die cavities. Furthermore, in order that complex contours can be achieved in a final stamped part, the addendum is often contoured itself to avoid wrinkling and undesired stretching in the contours of the final part. By providing a transition of the contour into the addendum, imperfections of the stamped part resulting from the stamping process can be maintained in the addendum. The addendum is then subsequently removed and the final stamped part containing the desired contours remains for use in its given application.

Springback or recoil is a condition that occurs when flat-rolled metal, such as sheet metal, is cold-worked as is common in the stamping industry. Upon release of the forming force, once the initial stamping is completed, the material has a tendency to partially return to its original shape due to the elastic recovery of the material. Springback is known to be influenced by the tensile and yield strengths of the material as well as by thickness, bend radius and the bend angle of the sheet metal resulting from the stamping process. In deep drawn sheet metal parts, recoil of the addendum, caused by the release of the internal stress of the curvature or contour in the addendum, as the addendum is severed from the final part, is not only a dangerous problem from a workplace safety standpoint, but also it effects the flow of scrap in a high efficiency situation such as an assembly line or mass production parts shop.

When the addendum is severed, to form the final part, for example in an assembly line or mass production parts shop situation where the process is likely substantially automated, the scrap region tends to release inconsistently out of the trimming mechanism or scrap cutter on an inconsistent basis and is not released to the proper place and not when the operator desires the scrap to be released from the cutter. The inconsistent release of the scrap from the scrap cutter often causes jams and prevents the scrap from exiting the die via the scrap chute, causing scrap build-up. Furthermore, the inconsistent scrap nesting locations and subsequent build-ups are known to cause damage to the scrap cutter cutting mechanisms as well as damage to the final part in the form of bent or chipped final part edges.

In addition to the aforementioned damage to the cutting edges and the final part, inconsistent release of the addendum from the scrap cutter results in long periods of downtime over a given period for the stamping and cutting machinery while a worker must manually remove the scrap jams in the scrap chute and other places as well as replace or repair damaged cutting edges of the scrap cutter. Therefore, it is desirable to develop a system of inhibiting the recoil of an addendum of a stamped part upon severing.

SUMMARY OF THE GENERAL INVENTIVE CONCEPT

At least one of the needs and objectives that will become apparent from the following description is achieved in an exemplary embodiment which comprises a sheet metal stamping device for stamping a sheet metal part comprising a first die body and a second die body. The first die body and the second die body are in operable communication for forming the sheet metal part from a sheet metal blank. The sheet metal part has at least one scrap region formed therein, where the at least one scrap region that is prone to recoil from a neutral stamped position. Both the first die body and the second die body have one or more complementary elongate bead forming portions located for forming an elongate bead region in the scrap region. The resultant elongate bead-forming regions are configured for the elongate bead to substantially inhibit recoil of the scrap region from the neutral stamped position when the scrap region is severed from the final part.

In an exemplary embodiment, the elongate bead forming portion located on the first die body provides a male bead-forming protrusion and the elongated bead-forming portion located on the second die body provides a die escape.

In an exemplary embodiment, the male bead-forming protrusion is shorter in length relative to the die escape.

In an exemplary embodiment, the elongate bead-forming portions are provided to form a bead about a bend radius of at least one portion of the scrap region.

In some exemplary embodiments, the sheet metal blank is provided as cold-rolled steel or aluminum, or other metals, metal alloys and the like.

In another exemplary embodiment, a sheet metal stamping device for stamping a sheet metal part, comprising a first die body and a second die body is provided. The first and second die bodies include first and second bead-forming sections respectively for forming at least one shape-retaining bead in a scrap region of an intermediate blank formation. The scrap region is separable from the intermediate blank formation to form a final sheet metal part and the first and second bead-forming sections are configured in order that the shape-retaining bead substantially retains the scrap region in a neutral stamped configuration following separation from the intermediate blank formation.

In another exemplary embodiment, a method is provided for substantially retaining the neutral stamped shape of a scrap region when the scrap region is severed from a sheet metal part comprising:

a) providing a sheet metal stamping device for stamping a sheet metal part; the device comprising a first die body and a second die body in operable communication for forming the sheet metal part from a sheet metal blank; the sheet metal part including at least one scrap region formed therein being prone to recoil from a neutral stamped position; the first die body and the second die body having complementary elongate bead-forming portions located for forming an elongate bead region in the scrap region for substantially inhibiting recoil of the scrap region from the neutral stamped position;

b) providing a sheet metal blank between the first die body and the second die body;

c) stamping the sheet metal part including at least one scrap region; and d) severing the scrap region from the final sheet metal part.

In another exemplary embodiment, a method for substantially retaining the neutral stamped shape of a scrap region when the scrap region is severed from an unfinished part comprising:

a) stamping a sheet metal blank so as to form the unfinished part;

b) including at least one elongate bead section in the scrap region of the unfinished part, wherein the elongate bead section extends along a region of the scrap region which is prone to recoil, and wherein the elongate bead section is shaped to inhibit the recoil; and c) severing the scrap region from the unfinished part so as to from a finished part.

In some exemplary embodiments, there are provided automotive vehicles and/or automotive vehicle parts made by the methods herein and/or by the devices herein.

BRIEF DESCRIPTION OF THE DRAWINGS

Several exemplary embodiments of the present invention will be provided, by way of examples only, with reference to the appended drawings, wherein:

FIG. 7 is sectional view of the upper and lower dies along line 6-6 of FIG. 5*a;*

FIG. 8 is a side view of a stamped component of a vehicle with a pair of associated scrap regions.

DESCRIPTION OF THE EXEMPLARY EMBODIMENTS

Figure 1:
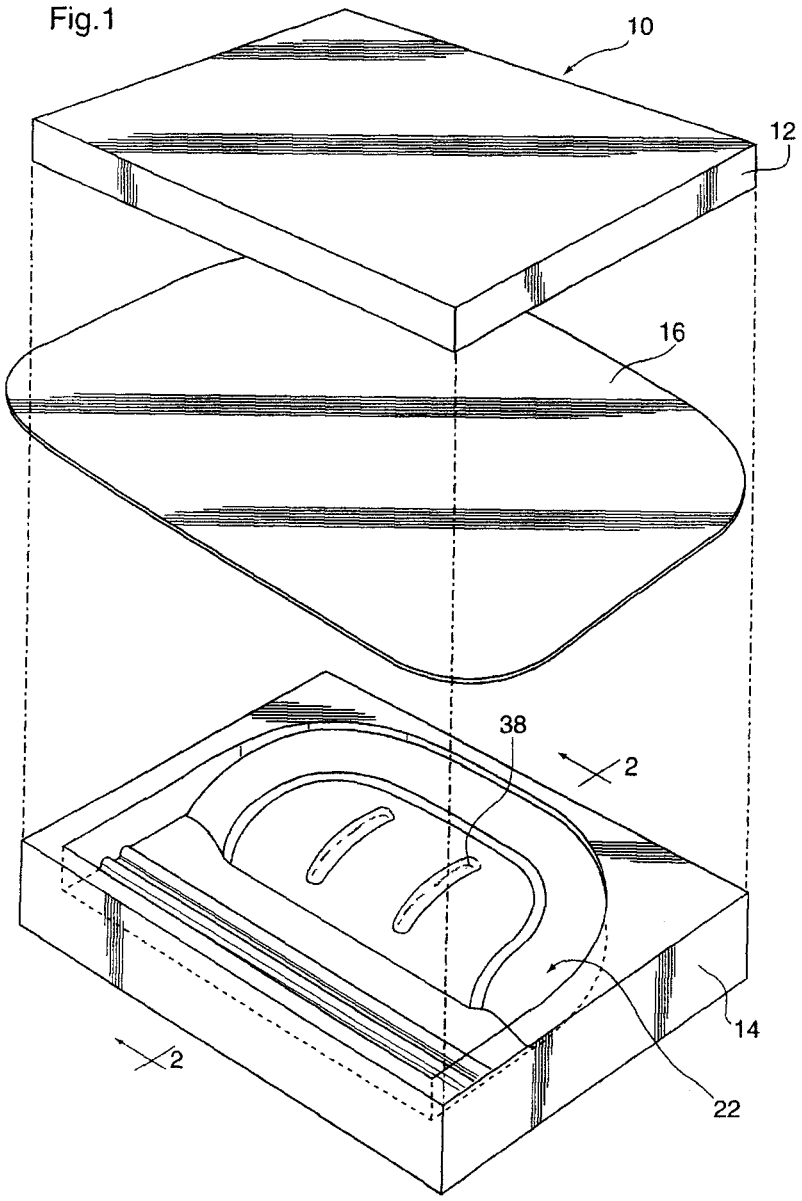
FIG. 1 is a perspective view of a stamping device in a first operative configuration.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical, other configurations illustrated in the drawings are intended to exemplify embodiments of the invention. However, other alternative mechanical or other configurations are possible which are considered to be within the teachings of the instant disclosure.

Figure 3:
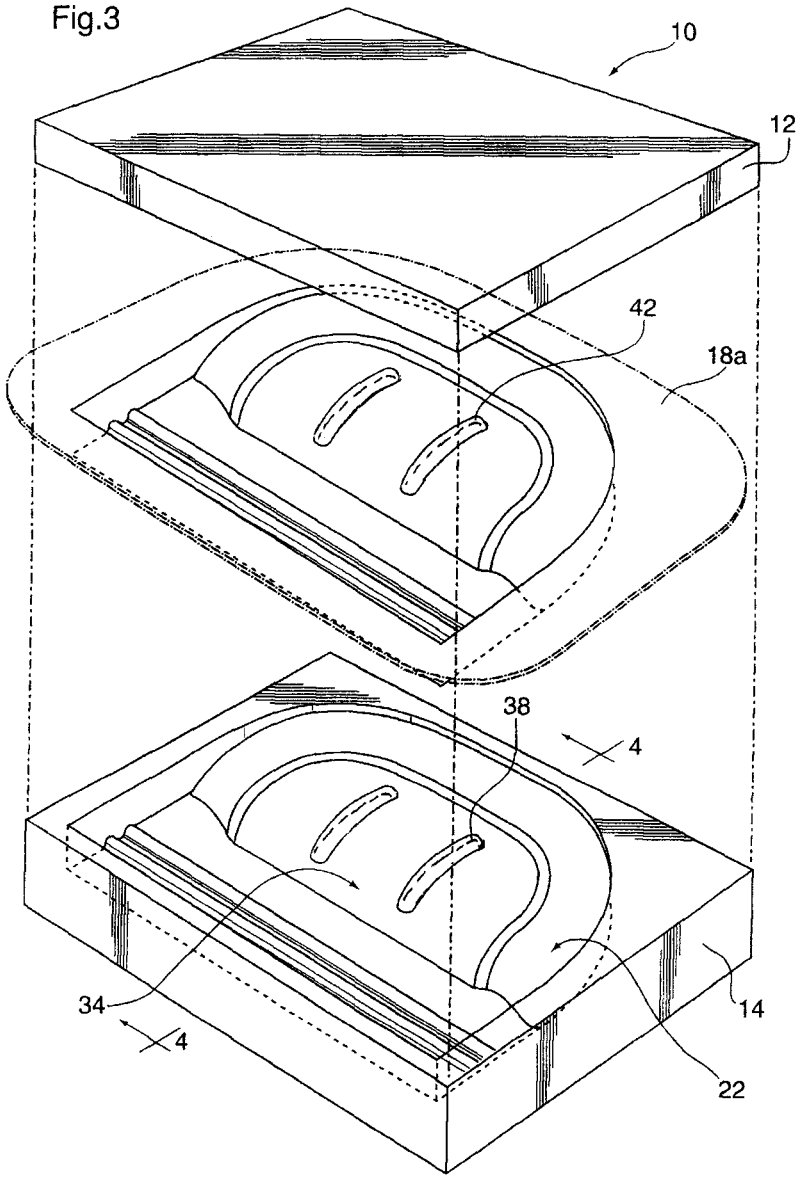
FIG. 3 is a perspective view of the stamping device of FIG. 1 in a second operative configuration.

With reference to figures, particularly FIGS. 1 and 3, there is provided a sheet metal stamping device 10 for substantially inhibiting recoil from a neutral stamped position of a scrap part region. The device 10 has a first die body 12 and a second die body 14. The first die body 12 and the second die body 14 are in operable communication such that in an open orientation as shown in FIG. 1, a sheet metal blank 16 may be inserted into the device 10 between the first and second die bodies 12, 14 for a stamping operation to produce an unfinished intermediate sheet metal part or formation 18*a* (FIG. 3).

Figure 2:
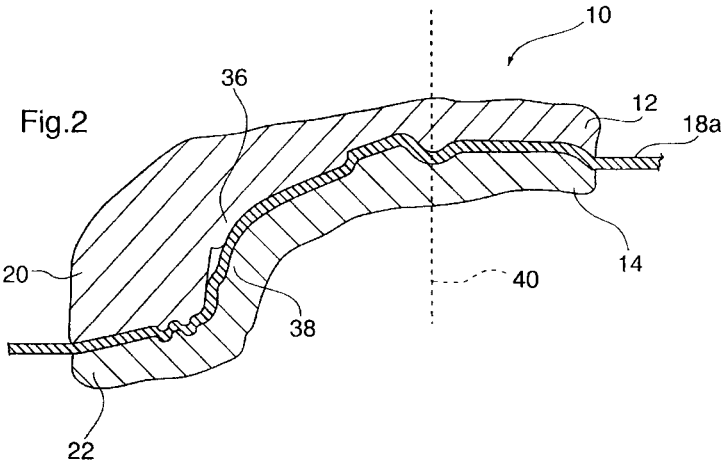
FIG. 2 is a sectional view along line 2-2 of FIG. 1.
Figure 4:
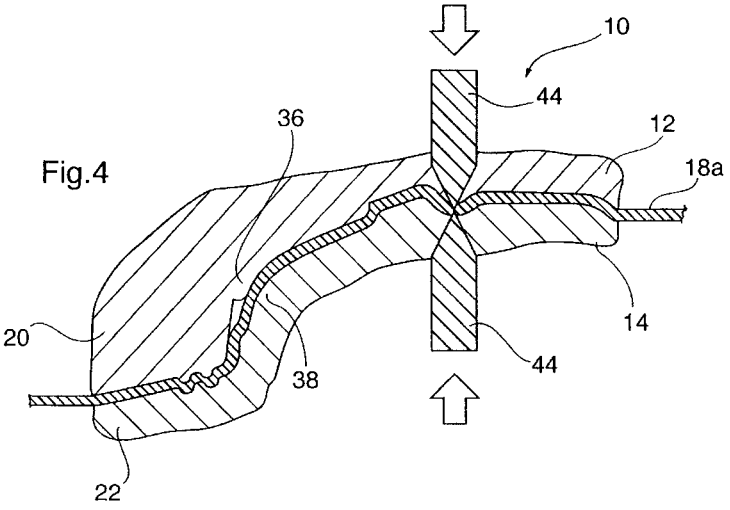
FIG. 4 is a sectional view along line 4-4 of FIG. 3.

The first and second die bodies 12, 14 include complementary regions to form the part. In this case, the first die body includes a male region in the form of a deep drawing protrusion region 20 as is shown in FIGS. 2 and 4 and the second die body 14 includes a complementary female region in the form of a deep drawing receiving region 22 shown in FIGS. 1 to 4. Of course, the deep drawing protrusion and receiving regions 20, 22 may be reversed as desired.

Figure 5A:
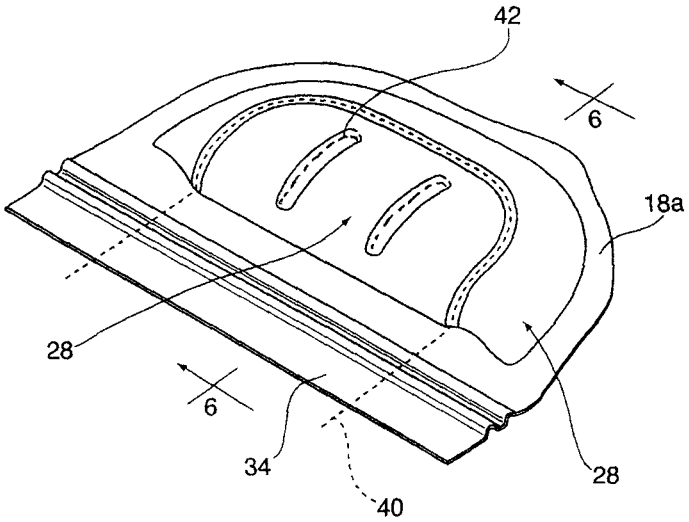
FIG. 5*a* is perspective view of an intermediate stamped part formed from the device of FIG. 1.
Figure 5B:
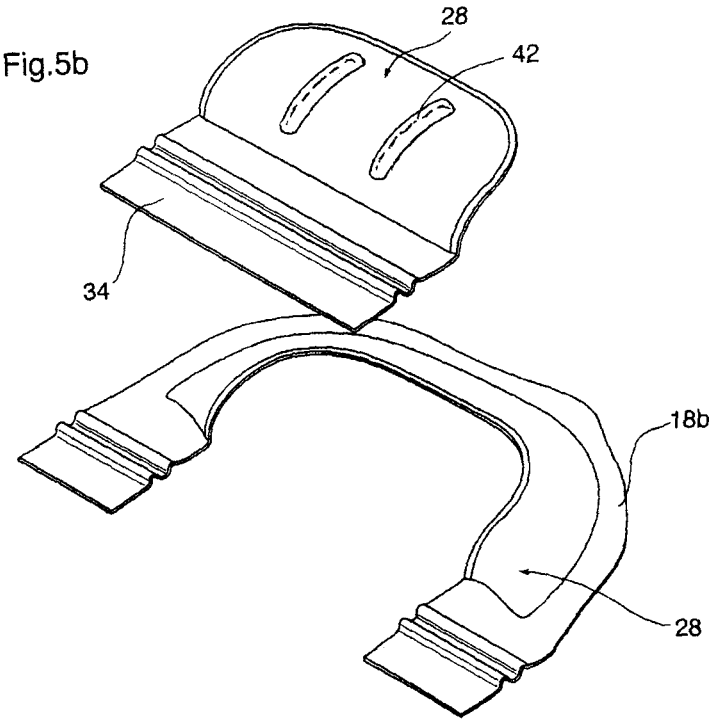
FIG. 5*b* is perspective view of a final stamped part and a scrap region severed therefrom.
Figure 6:
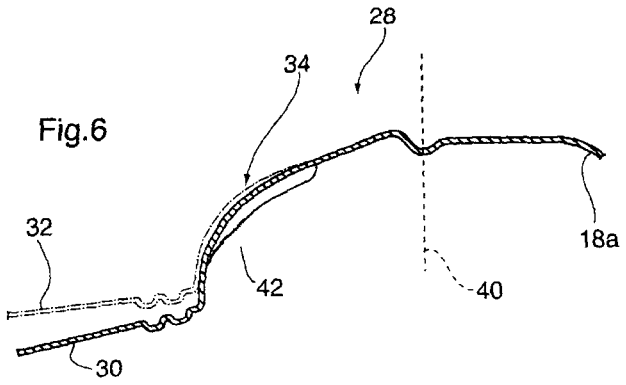
FIG. 6 is a sectional view along line 6-6 of FIG. 5*a;*
Figure 9A:
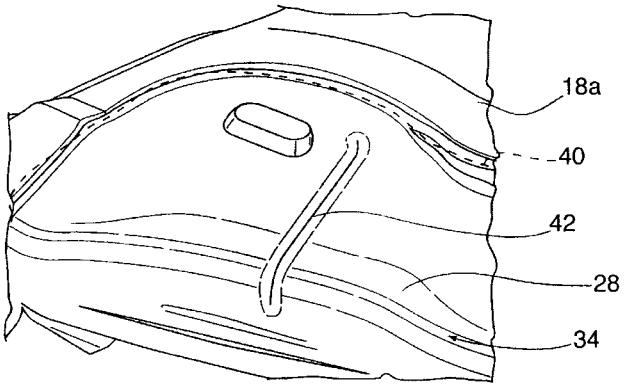
FIGS. 9*a* to 9*f* are perspective views of additional exemplary components of a vehicle.
Figure 9B:
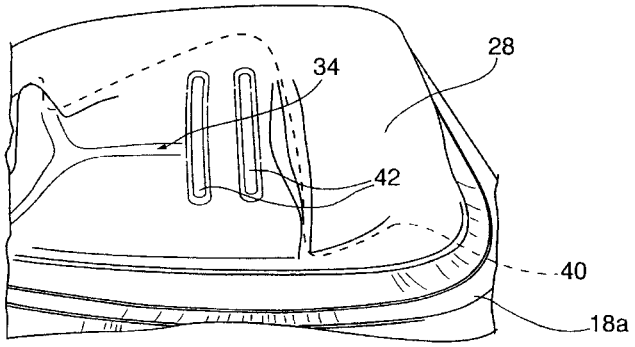
Figure 9C:
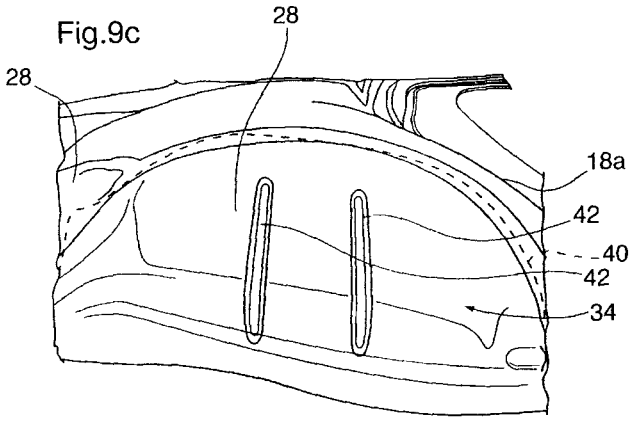
Figure 9D:
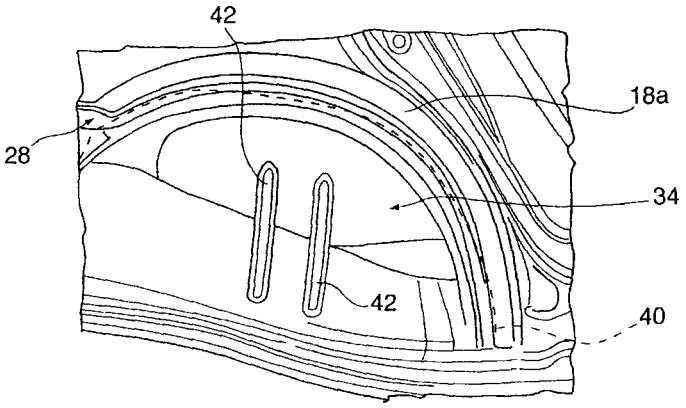
Figure 9E:
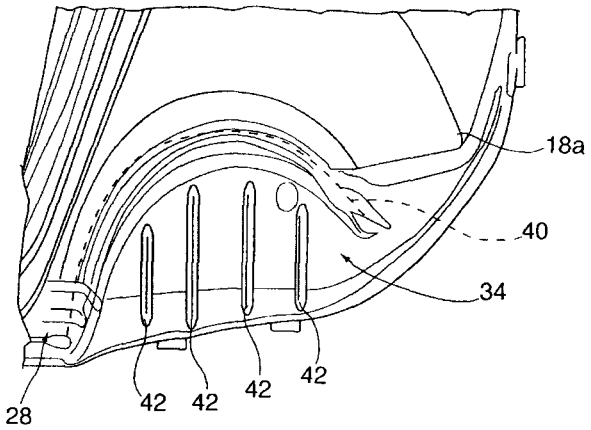
Figure 9F:
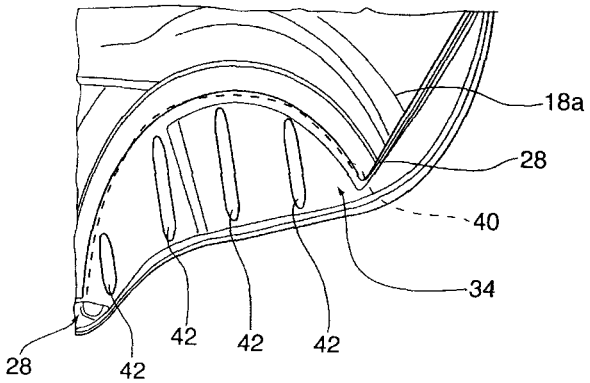

The deep drawing protrusion region 20 and deep drawing receiving region 22 are provided for stamping a part 18*a* or 18*b* that has complex contours such as those shown, by way of example only, at 28 in the final or finished part 18*b* in FIGS. 5*b* and 6. Such complex contours 28, tend to recoil from a neutral stamped position 30 as in FIG. 6, to a recoiled position 32 shown in ghost in FIG. 6.

Briefly, the following is provided with reference to the figures to further understanding of the invention. The property of recoil or springback is common in cold-rolled steel or aluminum sheet metal stamped parts (or stamped parts from other materials in which recoil may occur) and particularly problematic when an addendum or scrap region 34 is removed from a finished sheet metal part 18*b* as shown in FIG. 5*b*. The recoiling, for example, tends to lead to the scrap regions 34 releasing inconsistently from the trimming mechanisms in the production of the final stamped part 18*b*. Thus, the severed scrap regions 34 tend to inconsistently nest in the scrap cutter equipment (not shown) and cause build-ups which may damage the equipment or lead to production delays. For example, in order to the form the complex contours 28 in a final part 18*b*, the complex contours 28 may extend into a scrap region 34 which is to be removed from the final part 18*b*. The scrap region 34 may be required to be formed during the stamping process owing to the shape of the final part 18*b* or to serve as "relief regions" to avoid wrinkling or stretching in the contours 28 of the final part 18*b*. Thus, a portion of the contour 28 is often formed within the scrap region 34. When the scrap region 34 is removed, the contour 28 in the scrap region tends to recoil from the neutral stamped position 30 as in the unfinished part 18*a* shown by way of example, in the overlaid profile of FIG. 6 to a recoiled position 32 when it is severed from the unfinished part 18*a* to form the finished part 18*b* along the cut line 46. As noted above, the springback to a recoiled position 32 can be dangerous and problematic.

In order to control recoil associated with complex contours 28 in a part 18*a*, complementary elongate bead forming regions 36 and 38 are provided in the deep drawing protrusion region 20 and the deep drawing receiving region 22 for stamping an elongate bead 42 through a complex contour 28 in the scrap region as shown in FIGS. 1 to 4. The bead forming regions are provided as an elongate male bead-forming protrusion 36 located on either the first die body 12 or the second die body 14 and a complementary elongate bead die escape 38 located on the other. In this case, the complex contour 28 on the part 18*a* is provided as a a relatively tight bend region. Exemplary embodiments of stamped parts 18*a* shown in FIGS. 9*a* to 9*f* illustrate examples of complex contours 28 having elongated beads 42 formed therein and scrap regions 34. In this case, the bead forming regions are positioned so that beads extend through the bend region and are of a size and orientation to deform the scrap region to inhibit the recoil, arising in part from the bend region. The width, length and depth of the so-formed bead is then selected according to the sweep or extent of the bend and its radius, the thickness of the metal blank and its tensile strength, among other characteristics.

Furthermore, as is shown schematically in FIG. 4, for example, the scrap region 34 may be severed from the final part 18*b* (FIG. 5*b*) using a punch mechanism 44 operably incorporated in the upper and lower dies 12, 14. In various other embodiments, the punch mechanism 44 may be provided in a separate processing step. In additional exemplary embodiments, a separate processing step may be utilized to sever the scrap region 34 from the final part 18*b* along the cut line 40, as shown in the figures.

As shown in the figures particularly in FIGS. 2 and 3, the elongate bead forming regions 36 and 38 follow the contour 28 within the scrap region 34 to form the elongate bead, which in turn provides a stiffening effect to the contour 28 once it is severed from the final part 18*b*. The stiffening effect substantially maintains the scrap region 34 in a neutral stamped position 30 upon severance as is shown with reference to FIG. 6.

In certain embodiments, shown by way of example in FIGS. 2, 4 and 7, the elongate bead forming protrusion 36 may be shorter in length than die escape 38. The shorter length of the bead forming protrusion 36 relative the die escape 38 is provided such that material flow is not affected during the stamping process, thus increasing the quality of the final part 18*b*.

FIG. 8, by way of example, shows a final sheet metal stamped part 18*b* in this case for a vehicle panel. Scrap regions are provided at 34*a* and 34*b* which are deep-drawn by the interaction of the sheet metal blank 16 with the deep drawing protrusion region 20 and the deep drawing receiving region 22 during the stamping process. The scrap regions, shown in FIG. 8, are provided as a wheel-well scrap region 34*b* and a tail-light scrap region 34*a*, each with at least one elongate bead 42 for maintaining the scrap region 34 in a substantially neutral stamped position 30. In practice, when the scrap region 34 is severed from the final part 18 along the cut line 40, the scrap region 34 is substantially inhibited from recoil by the stiffing action of the elongated bead 42 about the complex contour 28 of the deep draw.

In practice, with particular reference to FIG. 6, the placement of at least one elongate bead 42 in a complex contour 28 or deep-drawn bend 28 may thus be provided to aid in shape-retention of the deep-drawn region. FIG. 6 shows the profile of a stamped part 18*a* along line 6-6 of FIG. 5*a*, wherein an elongate bead 42 is formed in the deep-drawn complex contour section 28 and a part cut line is represented as a dotted line at 40. Also in FIG. 6, shown in ghost, is the profile of the recoiled part 32 which does not have a bead 42 formed in a deep-drawn complex contour region 28 of the scrap region 34. Owing to the lack of a bead 42 in the ghosted recoiling part 32, the scrap region 34 is prone to recoil when severed from the final stamped part 18*b*. The neutral stamped position 30 of part 18*b* and the recoiling position 32 of the scrap region 34 are shown as overlays with the cut line 40 to denote the final part 18*b*, for explanatory purposes of the elongate bead 42.

Thus, in one example, the incorporation of at least one elongated bead 42 in the scrap region 34 by virtue of the stamping sheet metal stamping process and device 10, the scrap region 34 remains substantially rigid or otherwise substantially retains its stamped shape or profile, as defined by a neutral stamped position 30, once it is trimmed to from the final part 18*b*. By encouraging the scrap region 34 to remain in the neutral stamped position 30 after being trimmed from the final part 18*b*, the recoiling or springback properties of deep drawn sheet metal can be substantially controlled. Being able to better control the recoil properties of deep drawn scrap region 34 improves efficiency of certain aspects of the stamping manufacturing process. For example, by being able to maintain a more consistent shape of a severed scrap region 34 from one part to the next, recoil properties of the scrap region 34 can be better predicted and thus other components involved in a part-producing process, such as scrap kickers (not shown) and scrap trimmers (not shown) are less likely to be jammed or damaged by the scarp region 34 of various parts recoiling to unpredicted positions and causing jams or damage to the equipment of the part-producing process. Therefore, downtime related to clearing jams and maintaining equipment in the process is accordingly decreased by being able to substantially control the recoil characteristics of a severed scrap region 34.

Thus, the device 10 provides a method for substantially retaining the shape of a stamped metal part 18*a*, wherein a scrap region 34 is severed from the part 18*a* to form a final stamped part 18*b* as is shown in FIG. 5*b*. As is shown in FIG. 1 a sheet metal blank 16 is inserted between an upper die 12 and a lower die 14. The upper and lower dies 12, 14 are caused to communicate, or engage, with the sheet metal blank as is shown in FIG. 2 to produce and intermediate stamped part 18*a*, as shown in FIG. 3. At least one elongate bead 42 is formed in a scrap region of the intermediate stamped part 18*a*. The scrap region 34 is then removed along a predetermined cut line 40 (FIGS. 2, 5*a*, and 6) to produce a final part 18*b* as is shown in FIG. 5*b*. FIGS. 9*a* to 9*f* show various exemplary embodiments of stamped parts 18*a* prior the removal of the scrap region 34 along various respective cut lines 40. The elongate beads 42 formed in a deep-drawn complex contour 28 of the scrap region 34, thus substantially inhibit the scrap region 34 from undergoing recoil to a recoiled position 32 as in FIG. 6 when the scrap region 34 is severed.

Those of skill in the art will recognize certain modifications, permutations, additions and sub-combinations thereof of parts noted herein. While the sheet metal stamping device for substantially inhibiting recoil from a neutral stamped position of a scrap part region 10 has been described for what are presently considered the exemplary embodiments, the invention is not so limited. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A sheet metal stamping device for stamping a sheet metal part comprising a first die body and a second die body; the first die body and the second die body in operable communication for forming the sheet metal part from a sheet metal blank; the sheet metal part having at least one deep drawn part forming region and at least one deep drawn scrap region formed adjacent thereto, the scrap region including at least one outer periphery, and at least one deep drawn contoured section extending inwardly therefrom, the deep drawn contoured section having an arcuate cross section with a bend radius, wherein the deep drawn contoured section is prone to recoil from a neutral stamped position; the first die body and the second die body having one or more complementary elongate bead-forming portions located for forming an elongate bead in the deep drawn contoured section about the bend radius; the elongate bead-forming portions being configured for the elongate bead to substantially inhibit recoil of the deep drawn contoured section of the deep drawn scrap region from the neutral stamped position, that would otherwise occur when the deep drawn scrap region is severed from the final part.

2. The sheet metal stamping device as defined in claim 1, wherein the elongate bead-forming portion located on the first die body provides a male bead-forming protrusion and the elongate bead-forming portion located on the second die body provides a die escape.

3. The sheet metal stamping device as defined in claim 2, wherein the male bead-forming protrusion is shorter in length relative to the die escape.

4. The sheet metal stamping device as defined in claim 1, wherein the device is adapted to stamp a cold-rolled steel sheet metal part.

5. The sheet metal stamping device as defined in claim 1, wherein the first and second die bodies are configured to form an anchoring bead in the outer periphery, and wherein elongate bead is spaced from the anchoring bead.

6. A sheet metal stamping device for stamping a sheet metal part, comprising a first die body and a second die body; the first and second die bodies including first and second bead-forming sections respectively for forming at least one shape retaining bead about a bend radius of a deep drawn scrap region of an intermediate blank formation; the deep drawn scrap region including at least one outer periphery of the intermediate blank formation and at least one deep drawn contoured section extending inwardly from the periphery, the deep drawn contoured section having an arcuate cross section with a bend radius, wherein the shape retaining bead extends in the deep drawn contoured section, the drawn scrap region being separable from the intermediate blank formation to form a final sheet metal part; the first and second bead-forming sections being configured in order that the shape-retaining bead substantially retains the deep drawn contoured section of the deep drawn scrap region in a neutral stamped configuration following separation from the intermediate blank formation.

7. The sheet metal stamping device as defined in claim 6, wherein the first bead-forming section provides a male bead-forming protrusion and the second bead-forming section provides a die escape.

8. The sheet metal stamping device as defined in claim 7, wherein the male bead-forming protrusion is shorter in length relative to the die escape.

9. The sheet metal stamping device as defined in claim 6, wherein the device is adapted to stamp an intermediate automotive vehicle part from cold-rolled steel or aluminum.

10. The sheet metal stamping device as defined in claim 6, wherein the first and second die bodies are configured to form at least one anchoring bead in the outer periphery, and wherein the shape retaining bead is spaced from the anchoring bead.

11. A method for substantially retaining a neutral stamped shape of a deep drawn scrap region when the deep drawn scrap region is severed from a sheet metal part comprising:

a) providing a sheet metal stamping device for stamping a sheet metal part; the device comprising a first die body and a second die body in operable communication for forming the sheet metal part from a sheet metal blank; the sheet metal part including at least one deep drawn part forming region and at least one deep drawn scrap region formed adjacent thereto, the scrap region including at least one periphery, and at least one deep drawn contoured section extending inwardly therefrom, the deep drawn contoured section having an arcuate cross section with a bend radius, wherein the deep drawn contoured section is being prone to recoil from a neutral stamped position; the first die body and the second die body having complementary elongate bead-forming portions located for forming at least one elongate bead to extend in the deep drawn contoured section about the bend radius for substantially inhibiting recoil of the deep drawn scrap region from the neutral stamped position;

b) providing a sheet metal blank between the first die body and the second die body;

c) stamping the sheet metal part including at least one deep drawn scrap region; and d) severing the deep drawn scrap region from the final sheet metal part.

12. A method as defined in claim 11, wherein the elongate bead-forming portion located on the first die body provides a male bead-forming protrusion and the elongate bead-forming portion located on the second die body provides a die escape.

13. A method as defined in claim 12, wherein the male bead-forming protrusion is shorter in length relative to the die escape.

14. A method as defined in claim 11, wherein the steel sheet metal part is a vehicle part formed from cold-rolled steel or aluminum.

15. A method for substantially retaining the neutral stamped shape of a deep drawn scrap region when the scrap region is severed from an unfinished part comprising:

a) stamping a sheet metal blank so as to form the unfinished part with at least one deep drawn scrap region adjacent thereto, the scrap region including at least one outer periphery, and a deep drawn contoured section extending inwardly therefrom, the deep drawn contoured section having an arcuate cross section with a bend radius, wherein the deep drawn contoured section is prone to recoil from a neutral stamped position;

b) including at least one elongate bead section extending in the deep drawn contoured section about the bend radius thereof and whereby the elongate bead section is shaped to inhibit the recoil, and c) severing the deep drawn scrap region from the unfinished part so as to from a finished part.

16. A method as defined in claim 15, wherein the sheet metal blank is provided as a cold-rolled steel or aluminum blank and is stamped to form a vehicle part.

17. A method as defined in claim 15, wherein the elongate bead section of (b) is formed during the stamping of (a) by locating the sheet metal blank between a male bead-forming protrusion located on a first die body and a die escape located on the second die body.

18. A method as defined in claim 17, wherein the male bead-forming protrusion is shorter in length relative to the die escape.

* * * * *